US009845227B2

(12) United States Patent
Ojapalo et al.

(10) Patent No.: US 9,845,227 B2
(45) Date of Patent: Dec. 19, 2017

(54) MOBILE CRANE

(71) Applicant: KONECRANES PLC, Hyvinkää (FI)

(72) Inventors: Esa Ojapalo, Riihimäki (FI); Juha Santala, Kerava (FI); Hannu Oja, Hyvinkää (FI); Silvo Mikkonen, Vantaa (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 77 days.

(21) Appl. No.: 14/901,572

(22) PCT Filed: Jun. 26, 2014

(86) PCT No.: PCT/FI2014/050526
§ 371 (c)(1),
(2) Date: Dec. 28, 2015

(87) PCT Pub. No.: WO2014/207315
PCT Pub. Date: Dec. 31, 2014

(65) Prior Publication Data

US 2016/0137464 A1 May 19, 2016

(30) Foreign Application Priority Data

Jun. 27, 2013 (FI) ..... 20135703
Apr. 4, 2014 (FI) ..... 20145325

(51) Int. Cl.
*B66C 5/02* (2006.01)
*B66C 19/00* (2006.01)

(52) U.S. Cl.
CPC ..... *B66C 19/007* (2013.01)

(58) Field of Classification Search
CPC .... B66C 5/02; B66C 5/04; B66C 5/06; B66C 5/08; B66C 7/06; B66C 17/06; B66C 17/20; B66C 19/007
See application file for complete search history.

(56) References Cited

U.S. PATENT DOCUMENTS 3,602,375 A * 8/1971 Martinson ..... B65G 63/045 212/198
3,645,406 A 2/1972 Brazell
(Continued)

FOREIGN PATENT DOCUMENTS

CN 1243494 A 2/2000
CN 267350 Y 2/2005
(Continued)

OTHER PUBLICATIONS

Chinese Office Action and Search Report dated Jul. 7, 2017 for Application No. 201480046569.X with an English translation thereof.

*Primary Examiner* — Emmanuel M Marcelo
(74) *Attorney, Agent, or Firm* — Birch, Stewart, Kolasch & Birch, LLP

(57) ABSTRACT

A mobile crane including a frame which, in its upper part, is provided with a main support structure and which, in its lower part and on opposite sides of the lower part of the frame, is provided with lower beam structures transverse to the main support structure, and upright legs between the main support structure and the lower beam structures; at least one wheel or wheel arrangement at both ends of the lower beam structures, i.e. in each lower corner of the crane; a trolley arranged to move along the main support structure and provided with a hoisting member; at least one hoisting mechanism; at least one rope drum arranged to be run by the hoisting mechanism; and at least one rope arranged from the rope drum of the hoisting mechanism to the hoisting member for running it, the rope drum being further provided with at least one hoisting rope connected to at least one counterweight.

9 Claims, 3 Drawing Sheets

(56) References Cited

U.S. PATENT DOCUMENTS

Figure 1:
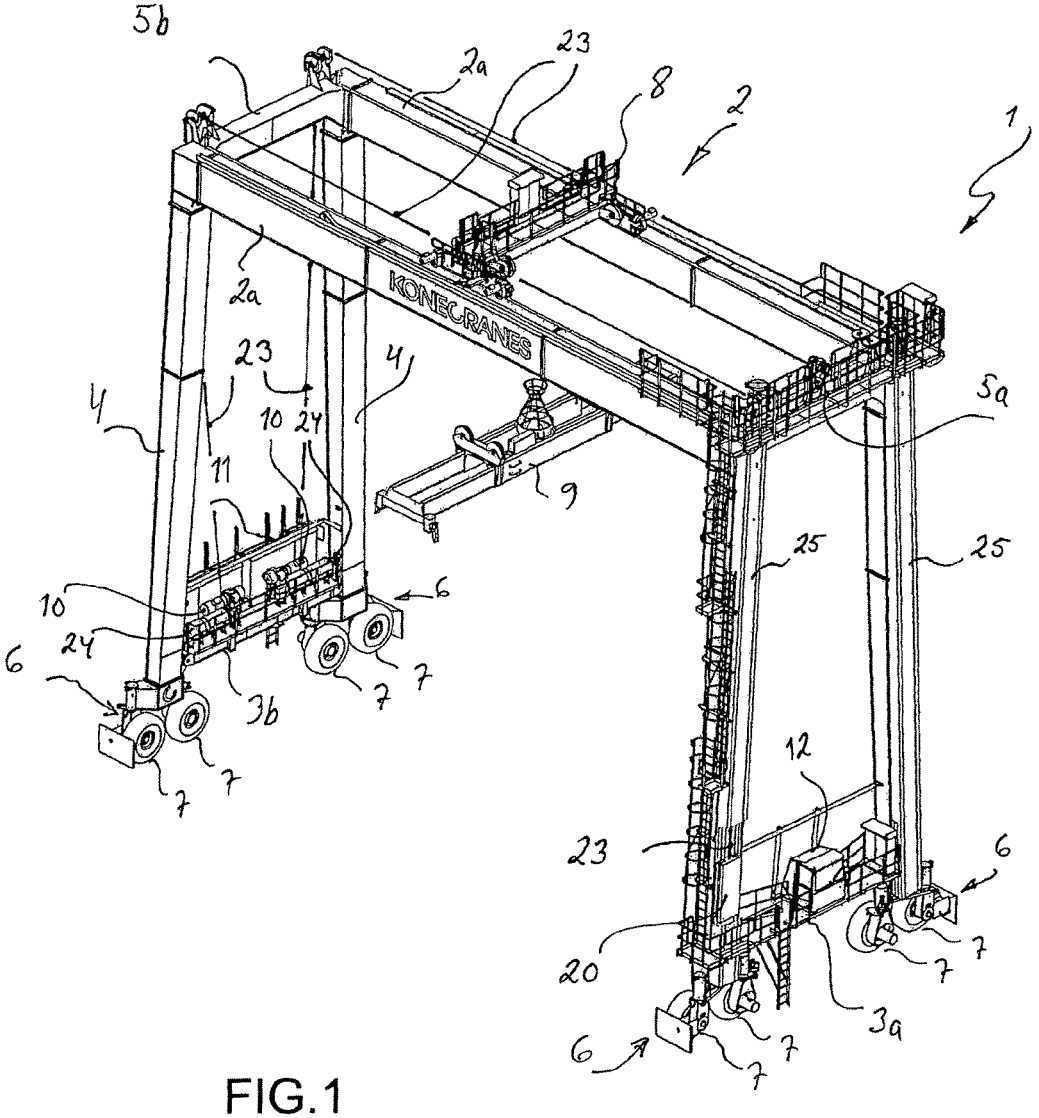

| | | | | |
|---|---|---|---|---|
| 3,792,779 | A | 2/1974 | Brazell | |
| 4,820,101 | A * | 4/1989 | Fenn | G06Q 10/08 177/147 |
| 5,265,741 | A * | 11/1993 | Shimizu | B66C 23/66 212/177 |
| 5,810,183 | A * | 9/1998 | Feider | B66C 19/007 212/291 |
| 6,250,486 | B1 | 6/2001 | Enoki | |
| 6,382,437 | B1 | 5/2002 | Okada et al. | |
| 9,336,505 | B1 * | 5/2016 | Meyers | G06Q 10/08 |
| 2003/0108405 | A1 | 6/2003 | Takehara et al. | |
| 2012/0138559 | A1 * | 6/2012 | Huff | E04C 3/10 212/175 |

FOREIGN PATENT DOCUMENTS

| | | | | |
|---|---|---|---|---|
| CN | 201288030 | Y | 8/2009 | |
| CN | 102616666 | A | 8/2012 | |
| EP | 1 506 888 | A1 | 2/2005 | |
| EP | 2962977 | A1 * | 8/2016 | B66C 5/02 |
| GB | 1085512 | A | 10/1967 | |
| GB | 2 168 310 | A | 6/1986 | |
| JP | 6-345381 | A | 12/1994 | |
| JP | 2012-126528 | A | 7/2012 | |
| KR | 10-1058594 | B1 | 8/2011 | |
| WO | WO 99/43534 | A1 | 9/1999 | |

* cited by examiner

MOBILE CRANE

BACKGROUND OF THE INVENTION

The invention relates to a mobile crane comprising a frame which, in its upper part, is provided with a main support structure and which, in its lower part and on opposite sides of the lower part of the frame, is provided with lower beam structures transverse to the main support structure, and upright legs between the main support structure and the lower beam structures; at least one wheel or wheel arrangement at both ends of the lower beam structures, i.e. in each lower corner of the crane; a trolley arranged to move along the main support structure and provided with a hoisting member; at least one hoisting mechanism; at least one rope drum arranged to be run by the hoisting mechanism; at least one rope arranged from the rope drum of the hoisting mechanism to the hoisting member for running the hoisting member.

Such yard gantry cranes for storage areas in container terminals are designed for arranging and handling containers in a container storage yard. They move along paths parallel with container rows, either on rails or rubber wheels.

Typically, the hoisting mechanism of such a crane is located in a trolley moving on top of the main support structure of the crane, in which case the masses to be moved are quite large, which has a substantial influence on the dimensioning of the support structures of the entire crane.

The known cranes on a mobile platform are susceptible to accelerations and decelerations as well as, in ports, typically, the influence of wind and stormy weather, and they are expected to be stable against falling down.

A known solution also requires demanding service and maintenance procedures to be taken into consideration in high places whereto the necessary, possibly heavy and large spare parts also have to be moved in connection with service operations.

SUMMARY OF THE INVENTION

An object of the invention is to provide a crane so as to enable the above-described problems to be solved. This object is achieved by a crane according to the invention, which is characterized in that the rope drum is further provided with at least one hoisting rope connected to at least one counterweight. Preferred embodiments of the invention are disclosed in the dependent claims.

When utilizing at least one counterweight in the hoisting mechanism, it is possible to dimension the hoisting mechanism smaller, thus enabling savings in materials and costs to be achieved in the form of structures, motors, instrumentation, and energy supply cables.

When a crane lifts a load, i.e. typically a container, into an upper position, the counterweight is at the same time lowered into a lower position. In this position, the crane is ready to move the container, and the crane is subjected to accelerations and decelerations in a direction of travel. Consequently, the stability of the mobile crane is better than without the implemented counterweights. Correspondingly, when the counterweight(s) is/are up, and the container is down, the container is not typically moving in the direction of travel but is usually positioning the container with gentle movements, i.e. lateral (the travel direction of the crane) accelerations and decelerations do not much influence the crane.

When the counterweight(s) is/are located in connection with the upright legs, it is possible to achieve a long and substantially vertical path for the counterweight to travel, supported and controlled. The upright leg provides the counterweight with a sufficiently stiff structure also in the crosswise direction for changes in acceleration and deceleration caused by movements in the travel direction. The upright leg is not absolutely vertical upwards but provides a slightly inclined surface for the counterweight to travel. The counterweight is thus lightly supported downwards against the surface of the upright leg, in which case it is prevented from swinging incessantly by its rope. Consequently, the movement of the counterweight is smooth, causing no noise, and no peenings nor flashes occur in the guide surfaces that would hinder the travel of the counterweight.

When the control cabin is located close to the ground level, exactly in front of the loading area, in the lower part of the leg structure at one end of the crane, in other words in connection with the aforementioned lower beam structure, it is possible to control the loading and unloading operations of trucks and carriages requiring special accuracy from a short distance and from the best possible monitoring site providing a crane operator with the shortest seeing distance to the loading area. This enables the operation to be made as safe as possible. An additional advantage herein is that the crane operator does not have to climb all the way to the main support level since the working height is at a substantially lower level than in a conventional yard gantry crane.

Similarly, when the hoisting mechanism is also located close to the ground level in connection with the other lower beam structure, it is possible to place them close to the main power source, making electrisation simpler and improving the weight distribution of the crane. Items in need of servicing are more easily available and the necessary spare parts can be easily brought thereto by means of a fork-lift truck, for instance. When the control cabin thus at the same time remains in connection with the lower beam structure located on a side opposite to the crane, the control cabin is situated far away from the sources of noise and vibration. While handling the load, when the container is lowered or lifted substantially at the level of the control cabin, the container itself forms a temporary noise wall between the machine unit and the control cabin.

When the machinery and the control cabin are moved from the trolley to be located close to the ground level, the trolley becomes light in structure, enabling also the support structure of the crane to be made lighter. At the same time, of course, the centre of gravity of the crane becomes to be situated lower, stabilizing the travel of the crane. Also, fewer passageways and platforms are required in the upper part when no emergency exits are necessary from top to bottom in case of fires or other accidents.

The parts of the crane are designed such that they can be packed and transported as modules in containers to the installation site. This makes the transportation easier to plan, when no large structural steel parts and components have to be transported separately as general cargo. The main support structure and the legs are built from interconnectable beam parts to be interconnected at the installation site. The rest of the parts are designed in a similar manner so as to be packed in containers.

LIST OF FIGURES

Figure 2:
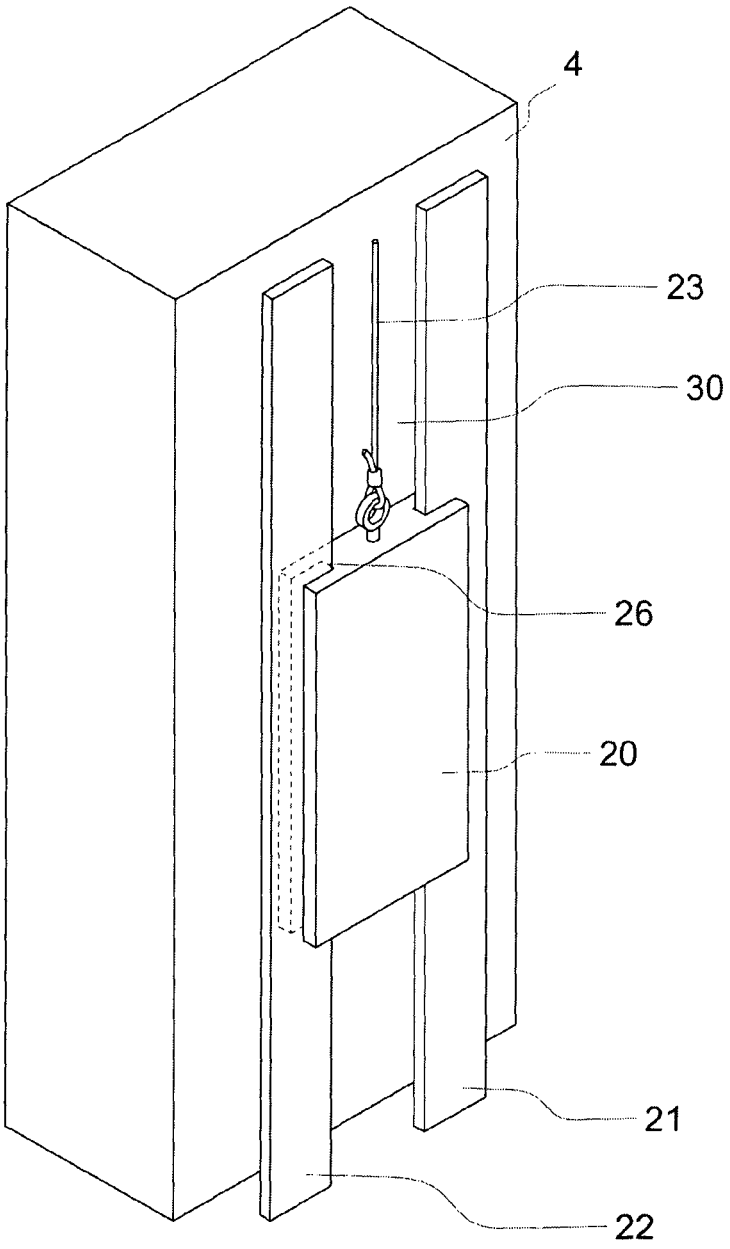
Figure 3:
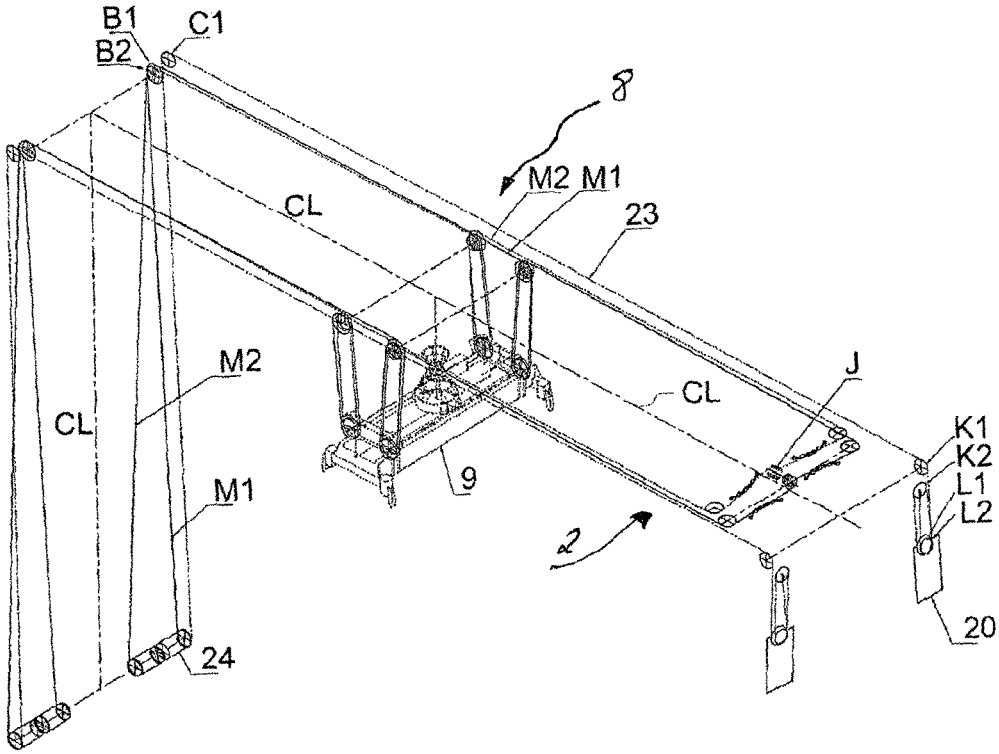

The invention is now explained in closer detail with reference to the accompanying drawings, in which FIG. 1 is a perspective view showing a crane according to the invention, FIG. 2 shows a counterweight, in its guides, according to the invention, and FIG. 3 shows an arrangement of a rope system according to the invention in a crane.

DETAILED DESCRIPTION OF THE INVENTION

Referring to the figures, a mobile crane according to the invention has a frame 1 which, in its upper part, is provided with a main support structure 2 and which, in its lower part and on opposite sides of the lower part of the frame 1, is provided with lower beam structures 3*a* and 3*b* transverse to the main support structure 2. The main support structure 2 is connected to the lower beam structures 3*a* and 3*b* by upright legs 4. The upright legs 4 are deflected from the vertical direction at least in one lateral direction in order to improve the stability of the crane. The main support structure 2 herein comprises two main supports 2*a* travelling, spaced apart from one another, parallelly and connected to one another by upper beam structures 5*a* and 5*b*.

Ends of the lower beam structures 3*a* and 3*b* are provided with bogie structures 6, each comprising two successive wheels 7. The total number of bogie structures 6 is thus four, one in each lower corner of the crane. In this example, the wheels are rubber wheels and, typically, one of the wheels 7 of each bogie 6 is a drive wheel while the other is a driven wheel. In connection with a rubber wheel crane, the wheels 6 are preferably also swivelable. Alternatively, the number of wheels 7 could be four in each bogie structure 6 (two pairs of wheels in succession), or only one wheel 7 could be provided in each lower corner (in which case the structure is not a bogie structure). As already stated above, the wheels of the crane could also be (nonswivelable) wheels travelling on rails.

Along the main support structure 2, a trolley 8 is arranged to move, a hoisting member or spreader 9 hanging therefrom.

The crane further comprises hoisting mechanisms 10, rope drums 24 arranged to be run by the hoisting mechanisms 10, and ropes M1 and M2 arranged from the rope drums 24 of the hoisting mechanisms 10 to the hoisting member 9 for running the hoisting member 9. The crane also has a main power source 11 and a control cabin 12 for the crane's operator. The control cabin 12 is located in connection with one lower beam structure 3*a* while the hoisting mechanism 10 is located in connection with the other lower beam structure 3*b*; to be more precise, in this example the control cabin 12 is located on top of the lower beam structure 3*a* and the hoisting mechanism 10 on top of the lower beam structure 3*b*. The control cabin 12 is located in the middle of the lower beam structure 3*a*. The main power source 11, in turn, is located in connection with the same lower beam structure 3*b* as the hoisting mechanism 10. Preferably, the control cabin 12, the hoisting mechanism 10, and the main power source 11 are modular structures to be installed in the crane.

According to the invention, the rope drums 24 are further provided with hoisting ropes 23 connected to counterweights 20 which herein are arranged to move in guides 21, 22 arranged in side surfaces of the upright legs 4. The rope drums 24 and the counterweights 20 are arranged to alternately run one another through the hoisting ropes. These counterweights 20 may also be modular structures to be installed in the crane. In the overall arrangement of the hoisting ropes 23 it is appropriate that on opposite sides of the trolley 8 the hoisting mechanism 10 is located on one side while the rope system led to the counterweight 20 resides on a side opposite thereto, i.e. preferably on the side of the control cabin 12. Thus, the force provided by the counterweight 20 is transmitted through the rope drum 24 to the hoisting mechanism 10, in which case the hoisting capacity required from the hoisting mechanism 10 is smaller than if the structure were built with no counterweights 20. Typically, a counterweight 20 is always supported by a hoisting rope 23, i.e. it is not lowered onto a separate platform or the like; consequently, the hoisting rope 23 is always subjected to a gravity force on account of the counterweight 20.

On the side surface of the upright leg 4, the guides 21, 22 reside in a protected slot in order to prevent the counterweight 20, which moves up and down, from creating a compressing jaw. The slots, already at their bottom, are appropriately at least of the same height as the control cabin 12 in the vicinity of the control cabin 12 but may also all the way to the top be protected by protective plates 25. A space to be reserved for the travel of the counterweight 20 and the guides 21, 22 may also be provided inside the upright leg 4 with a box-type structure, in which case no separate structure in the form of protective plates 25 is necessary.

Preferably, the number of counterweights 20 including their guides 21, 22 is two, i.e. both the upright leg 4 and the hoisting mechanism 10 in question are provided with one of their own. Two counterweights 20 enable such an advantage to be achieved that in the hoisting mechanisms 10 it is possible in the run of the hoisting rope 23 to carry out independent rope movements and forces, in which case the inclination and skew of the container to be attached to the hoisting member 9 and the hoisting member 9 can be controlled accurately in order to achieve a correct inclination and skew around the vertical axis so as to ensure that grabbing and releasing the container take place in a safe and quick manner.

The guides 21, 22 are located such that a first guide 21 supports the counterweight on the upright leg 4 sideways (the direction of travel of the crane) while a second guide 22 supports the counterweight 20 in the direction of the main support structure 2 of the crane. Thus, the counterweight is supported in two substantially transverse directions. The guides 21, 22 may also be implemented such that when the counterweight is arranged between the guides, they both restrict lateral movement. The movement parallel with the main support structure 2 is restricted such that the counterweight 20 is provided with a groove 28 wherein the guide 21, 22 is arranged, as shown in FIG. 2. The controlled support of the counterweight 20 may naturally be implemented in many different ways by using different profiles or bars capable of providing a sufficient support in x and y directions of a three-dimensional coordinate system when the counterweight moves in z direction in the direction of the upright leg 4. It is also possible to install between the counterweight 20 and the upright leg 4 a sliding plane 30 to support the counterweight 20 for instance by its face when the direction of the upright leg 4 slightly differs from the vertical surface. The sliding plane 30 enables a suitable kinetic friction to be provided to prevent the counterweight 20 from swinging freely, which would cause noise. The friction may naturally also be arranged by means of the guides 21, 22 or bars. The sliding plane 30 may be the same as the surface of the upright leg 4 between the guides 21, 22, or it may further be provided with an appropriate additional material for forming a suitable friction coefficient of the sliding plane 30.

The number of counterweights 20 may also be only one, in which case a force-balancing member has to be arranged separately, i.e. balancing scales, a wheel or a joint has also to be provided if the controlled inclination and skew around the vertical axis are to be implemented. As far as the distribution of the load of the crane is concerned, it is optimal for the wheels 7 when the counterweight 20 resides in the frame 1 on a side opposite to that of the hoisting mechanism 10. This enables dead mass to be distributed on both wheel rows. It is possible to arrange the counterweight 20 on the same side as the hoisting mechanism 10, though.

It is also possible to provide the counterweight 20 with a space or a framework to enable for instance tools or spare parts to be loaded therein for service. When a counterweight 20 in the lower position is provided with a hatch or a door in the protective plate 25, it is possible to lift up heavy objects by means of the counterweight 20 and the hoisting mechanism 10 for servicing the crane when a corresponding access is provided in the upper position through the protective plate 25 to the counterweight 20.

FIG. 3 shows how a rope system implemented with a counterweight 20 is arranged in a mobile crane. The viewing angle in FIGS. 1 and 3 is the same, so the reference numerals are found in substantially the same places, excluding the different height position of the counterweights 20 used on account of the properties of the drawing. The rope system is symmetrical with respect to a centre line CL, so only one rope system line is described herein. In order to operate the hoisting member 9, the ropes M1, M2 are run from the rope drum 24 via upper rope pulleys B1, B2 to the hoisting member 9 hanging underneath the trolley 8. From the hoisting member 9, the ropes are led back up and, remaining up there, they keep further running forward in the direction of the main support structure 2, ending up at a mechanism J for controlling the skew of the hoisting member 9. This control mechanism J may be used for controlling the skew occurring around the vertical axis of the hoisting member 9. By means of two rope runs and two hoisting mechanisms 10 parallel with respect to the centre line CL, both being provided with the ropes M1, M2, it is possible to implement the inclination of the hoisting member 9 so that the ends of the hoisting member 9 (and thus the ends of the container being handled) may be brought in mutually different height positions, which may be a property necessary to utilize when lowering the container for instance onto a slightly slanting truck trailer or onto a slanting ground. It is also necessary to be able to grab a slanting container to be lifted.

From the rope drum 24, also the hoisting rope 23 is led which runs mainly alongside with the ropes M1, M2. The hoisting rope 23 is led from the rope drum 24 via a rope pulley C1 past the trolley 8 and, further, alongside with the main support structure 2, to rope pulleys K1. Therefrom, the hoisting rope 23 continues downwards to a rope pulley L1, rises back to a rope pulley K2 rotatably fastened to the frame 1, further descends to a rope pulley L2, and returns back up again to a fastening point of the hoisting rope 23, which may be located for instance in connection with the hub of a rope pulley K2. The rope pulleys L1, L2 are rotatably fastened to the counterweight 20, they may rotate irrespective of one another and differ in diameters.

This solution enables the rope force provided by the counterweights 20 to be transmitted to the rope drum 24. The counterweights 20 are always suspended by the hoisting rope 23, so the hoisting rope 23 stays naturally tight. It is also possible to arrange rope pulleys (not shown) parallel with the main support structure 2 to support the run of the hoisting rope 23.

The hoisting rope 23 and the ropes M1, M2 differ clearly from one another, a first difference being the different direction of rotation of the rope on the rope drum 24. This difference in the direction of rotation enables the rope force provided by the counterweight 20 to be transmitted directly to the hoisting mechanism. The next difference is in passing the trolley 8, i.e. the hoisting rope 23 does not run via the hoisting member 9 but continues directly to the counterweights 20. Consequently, it has nothing to do with the mechanism J for controlling the skew of the hoisting member 9, either. When the counterweights 20 are located on a side opposite to that of the rope drum 24 and the hoisting mechanism 10, the distribution of mass becomes advantageous on both sides of the crane, evening out the wear of the wheels 7 and, also, the control of the crane being driven.

By utilizing the additional force provided by the counterweight 20, the hoisting mechanisms 10 can be dimensioned to be smaller in their structure and energy supply cables and, further, the arrangement saves energy.

Typically, the mass of a counterweight 20 may be dimensioned so that the rope force provided thereby substantially corresponds to the mass of an empty hoisting member 9. This enables a considerable improvement to be achieved in energy use as the crane lifts and lowers an empty hoisting member 9 for a considerably long stretch of time during its work cycles. It is preferable that the rope rotation between K1-L1-K2-L2 in connection with the counterweight 20 equals in number that provided between the trolley 8 and the hoisting member 9. The examples shown in FIGS. 1 and 3 both employ a solution with four ropes. In such a case, the hoisting height of the hoisting member 9 and the counterweight 20 is substantially the same, thus making dimensioning easy.

It is preferable to provide the trolley 8 and the hoisting member 9 with cameras (not shown) to enable the container handling procedures in the storage area to be carried out sufficiently accurately, as the crane operator no longer monitors the storage sites obliquely downward.

Typically, such a crane is large, in which case the main support structure 2 extends over a plurality of lines of containers. In order to be able to further move the centre of gravity of the crane lower, it is preferable to make the main supports 2*a* reside close to one another, in which case the upper beam structures 5*a* and 5*b* become shorter and, thus, lighter. Thus, the upright legs 4 then obliquely join the lower beam structures 3*a* and 3*b*, when viewing the crane from its side. This, of course, at the same time saves material, stabilizes the entire crane and makes the structure stiffer.

This structural entity according to the invention enables the advantages described in detail above to be achieved.

The above description of the invention is only intended to illustrate the basic idea of the invention. A person skilled in the art may thus vary its details within the scope of the attached claims. It is to be noted that the main power source may alternatively also comprise a cable drum and a guide bar, in which case the appearance of the crane differs from the structure being shown in the drawing. In such a case, the crane depends on an external energy source, and it is supplied by an electric cable following the surface of the ground and being uncoiled by the crane onto the large cable drum. This embodiment may be relevant in connection with a crane travelling on rails.

The invention claimed is:

1. A mobile crane designed for arranging and handling containers in a container storage yard comprising:

a frame which, in an upper part thereof, is provided with a main support structure and which, in a lower part thereof and on opposite sides of the lower part of the frame, is provided with lower beam structures transverse to the main support structure, and upright legs between the main support structure and the lower beam structures;

at least one wheel or wheel arrangement at both ends of the lower beam structures;

a trolley arranged to move along the main support structure and provided with a hoisting member;

at least one hoisting mechanism;

at least one rope drum arranged to be run by the hoisting mechanism; and at least one rope arranged from the at least one rope drum of the hoisting mechanism to the hoisting member for running the hoisting member, wherein the at least one rope drum is further provided with at least one hoisting rope connected to at least one counterweight, and wherein the counterweight is arranged in the frame on a side opposite to the hoisting mechanism.

2. The crane as claimed in claim 1, wherein the counterweight is arranged to move parallel with the upright leg.

3. The crane as claimed in claim 1, wherein the counterweight is arranged to move on a surface of the upright leg different from a vertical surface.

4. The crane as claimed in claim 1, wherein the number of counterweights is two, each being connected separately to a hoisting mechanism of its own.

5. The crane as claimed in claim 1, wherein the counterweight is controllingly supported by guides in two substantially transverse directions.

6. The crane as claimed in claim 1, wherein at least some of a group consisting of a control cabin, hoisting mechanism, main power source, a counterweight, and a wheel arrangement are modular structures to be installed in the crane.

7. The crane as claimed in claim 1, wherein the trolley and the hoisting member are provided with cameras.

8. The crane as claimed in claim 1, wherein a rope rotation in connection with the counterweight equals in number a rope rotation between the trolley and the hoisting member.

9. The crane as claimed in claim 1, wherein the at least one wheel or wheel arrangement are in each lower corner of the crane.

* * * * *